US007451498B2

(12) United States Patent
Kuroda

(10) Patent No.: US 7,451,498 B2
(45) Date of Patent: Nov. 18, 2008

(54) FACE MASK FOR DIVING

(75) Inventor: Yuji Kuroda, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 215 days.

(21) Appl. No.: 11/338,640

(22) Filed: Jan. 25, 2006

(65) Prior Publication Data

US 2006/0162055 A1 Jul. 27, 2006

(30) Foreign Application Priority Data

Jan. 26, 2005 (JP) ..... 2005-018222

(51) Int. Cl.
*A61F 9/02* (2006.01)

(52) U.S. Cl. ..... 2/428; 2/9

(58) Field of Classification Search ..... 2/427, 2/428, 9; 351/155
See application file for complete search history.

(56) References Cited

U.S. PATENT DOCUMENTS

| | | | | |
|---|---|---|---|---|
| 3,725,953 | A * | 4/1973 | Johnson et al. | 2/428 |
| 5,742,946 | A * | 4/1998 | Garofalo | 2/428 |
| 6,029,284 | A * | 2/2000 | Kawashima et al. | 2/428 |
| 6,192,523 | B1 * | 2/2001 | Pan | 2/428 |
| 6,484,324 | B2 * | 11/2002 | Garofalo | 2/428 |
| 6,996,857 | B2 * | 2/2006 | Fukasawa | 2/428 |
| 7,181,778 | B1 * | 2/2007 | Garraffa et al. | 2/428 |

FOREIGN PATENT DOCUMENTS

| | | |
|---|---|---|
| JP | 3536004 | 3/2004 |

* cited by examiner

*Primary Examiner*—Katherine Moran
(74) *Attorney, Agent, or Firm*—Clark & Brody

(57) ABSTRACT

A face mask for diving includes a distal edge of a face-contactable section of a skirt attached to a lens frame are made roundly bulge so as to have a substantially circular cross-sectional shape.

6 Claims, 5 Drawing Sheets

FACE MASK FOR DIVING

BACKGROUND OF THE INVENTION

The present invention relates to a face mask for diving and more particularly to a configuration presented by sections of a skirt as an important part of such a mask which are elastically held in contact with the wearer's face.

In conventional diving face masks, for example, one of them as disclosed in Japanese Patent Publication No. 3536004, the basic structure comprises a lens frame including a lens retained thereby and the skirt attached to the lens frame. The skirt is of a substantially cylindrical shape partially defining a face-contactable section. The face-contactable section generally has in its distal edge a relatively sharpened cross-sectional shape. This aspect will be more specifically understood from FIG. 5 in the accompanying drawings as showing prior art. FIG. 5 is a partial sectional view showing a cross-sectional shape of the face-contactable section in such a conventional diving face mask. As shown, the face-contactable section 100 is bifurcated into an inward extending sub-section 101 and an outward extending sub-section 102 respectively having relatively sharpened distal edges 103, 104 to be pressed against the wearer's face when the wearer puts the mask on his or her face.

In the case of the conventional diving face mask as has been described above, the distal edges of the respective face-contactable sections being pressed against the wearer's face may often leave a compression mark on the wearer's face. Depending on its degree and/or even if it is merely of a temporary nature, such a compression mark inevitably disfigures the wearer's face and/or may sometimes cause skin disease.

SUMMARY OF THE INVENTION

In view of the problem as has been described above, i.e., the problem due to the face-contactable section of the skirt in the conventional diving face mask, it is an object of the present invention to provide a diving face mask improved so that the face-contactable section thereof do not leave any compression mark on the wearer's face.

The object set forth above is achieved, according to the present invention, by a face mask for diving comprising a lens frame including a lens retained thereby, a substantially cylindrical skirt having a proximal edge fixed to the lens frame and a face-contactable section adapted to be elastically held in contact with the wearer's face. The present invention further comprises the face-contactable section having a distal edge roundly bulging so as to have a substantially circular cross-sectional shape.

According to the present invention, the face-contactable section is preferably bifurcated into an inward extending sub-section and an outward extending sub-section both having respective distal edges roundly bulging so as to have substantially circular cross-sectional shapes. It is ensured thereby that the face-contactable sections are held in contact with the wearer's face with high reliability and stability and the skirt effectively functions.

For further improvement of such function, the skirt preferably has a bifurcation point located approximately at midpoint between the proximal edge and the distal edge of the outward extending sub-section and the skirt preferably has a thickness gradually reduced from the bifurcation point toward the distal edges of the inward and outward extending sub-sections but increased again at the respective distal edges. In general, the respective face-contactable sections are formed so as to be thinner than the respective proximal edges of the skirt. However, the respective distal edges roundly bulge and have correspondingly increased thickness so that these distal edges function as reinforcing ribs. Consequentially, these distal edges are stably held in water-tight contact with the wearer's face without unintentional deformation and thereby prevent water from flooding the interior of the mask.

For still more effective function of the mask, at least the outward extending sub-section of said inward and outward extending sub-sections preferably has its inner surface concavely curved. With such a configuration, the curved surface is deformed against its elasticity to a planar state as the curved surface is pressed against the wearer's face and, as a result, the area over which this surface is elastically held in contact with the wearer's face is correspondingly enlarged.

With the face mask for diving according to the present invention, it is unlikely that the distal edges of the respective face-contactable sections of the skirt might leave compression marks after the mask has been put off because these distal edges since these distal edges roundly bulge so as to have substantially circular cross-sectional shapes.

DETAILED DESCRIPTION OF THE PREFERRED EMBODIMENTS

Preferred embodiments of the face-mask for diving according to the present invention will be described in details with reference to the accompanying drawings.

Figure 1:
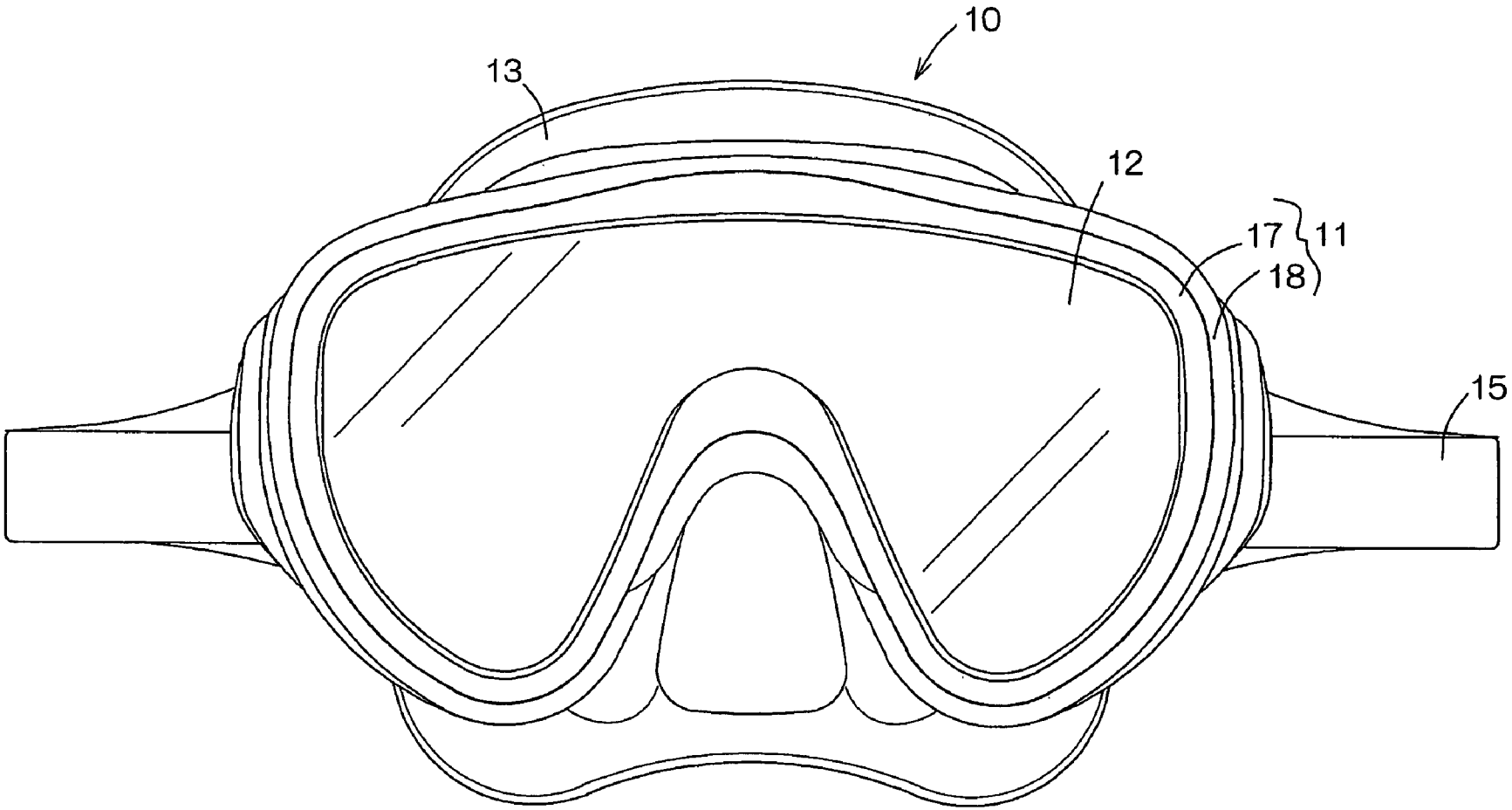
FIG. 1 is a front view showing a first embodiment of the present invention as a face mask for diving.
Figure 2:
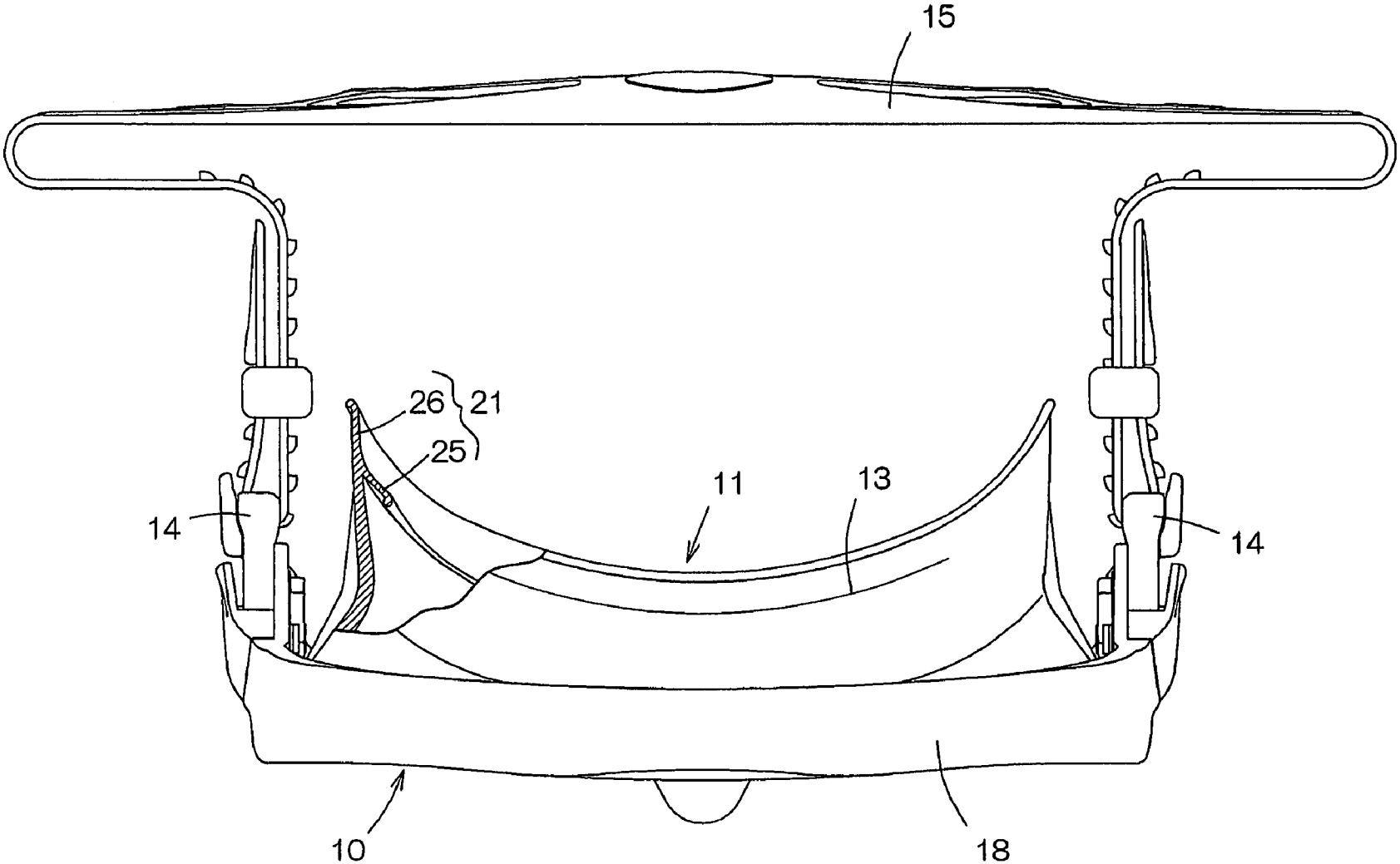
FIG. 2 is a partially cutaway plan view showing the face mask of FIG. 1.
Figure 3:
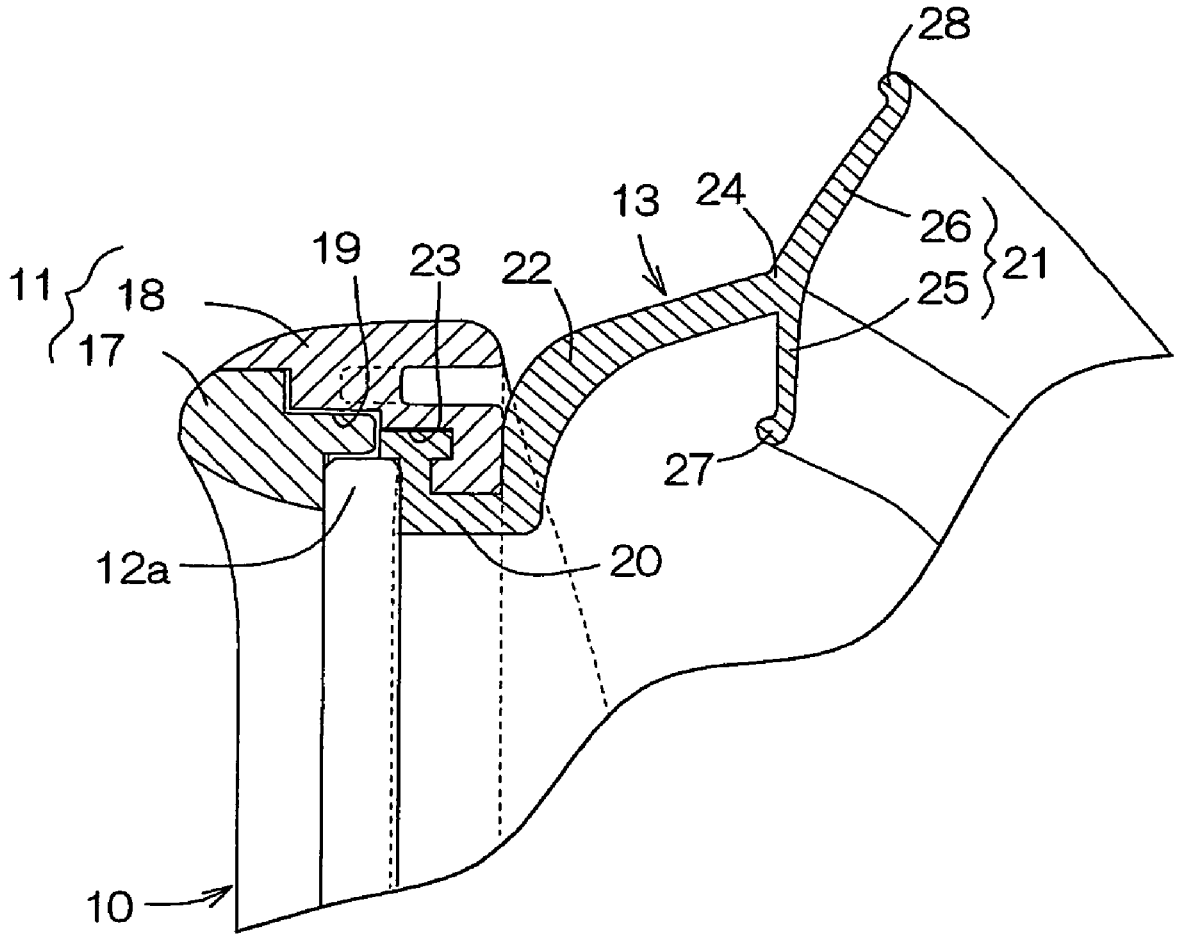
FIG. 3 is a scale-enlarged sectional view showing an important feature found at each lateral portion of the face mask of FIG. 1.

Referring to FIGS. 1 through 3 showing a first embodiment of the present invention, a face mask 10 for diving comprises a lens frame 11, a lens 12 retained by the lens frame 11, a skirt 13 attached to the lens frame 11 so as to extend rearward from the lens frame 11 and a strap 15 connected to transversely opposite sides of the lens frame 11 by means of buckles 14.

The lens frame 11 comprises inner and outer frames 17, 18 each made of a hard plastic material. The lens 12 has a peripheral edge 12*a* set in an annular retention groove 19 defined between inner peripheries of the inner and outer frames 17, 18 and retained therein. The skirt 13 is made from a relatively hard rubber or plastic material in a substantially cylindrical shape having a proximal edge 20, a pair of face-contactable sections 21, an intermediate section 22 extending between the proximal edge 20 and the respective face-contactable sections 21. The proximal edge 20 is set in an annular retention groove 23 defined between inner peripheries of the inner and outer frames 17, 18 and retained therein.

As shown in FIG. 3 in a scale-enlarged sectional view, the skirt 13 is most thick in a region of the intermediate section adjacent the proximal edge 20 and this thickness is gradually reduced toward the face-contactable section 21. In a bifurcation point 24 in the intermediate section 22, the face-contactable section 21 is bifurcated into an inward extending sub-section 25 and an outward extending sub-section 26. The inward extending sub-section 25 extends inward as viewed in a radial direction of the skirt 13 from the bifurcation point 24 and has its thickness gradually reduced toward a distal edge 27. The outward extending sub-section 26 extends outward as viewed in the radial direction of the skirt 13 from the bifurcation point 24 by a dimension longer than the inward extending sub-section 25 and has its thickness gradually reduced toward a distal edge 28. It should be noted here that the thickness of the inward extending sub-section 25 is less than the thickness of the outward extending sub-section 26 and, consequentially, a pressure under which the inward extending sub-section 25 elastically contacts with the wearer's face is less than a pressure under which the outward extending sub-section 26 elastically contacts with the wearer's face. The distal edges 27, 28 roundly bulge so as to have substantially circular cross-sectional shapes, respectively. Compared with the conventional face mask including the relatively sharpened distal edges as has previously been described, the face mask according to the invention eliminates the problem of the compression marks which might be left after the face mask 10 has been put off since there is no anxiety that the roundly bulging distal edges 27, 28 are locally and sharply pressed against the wearer's face. Even if any compression mark is left, such compression mark will disappear after a relatively short period has elapsed.

Figure 4:
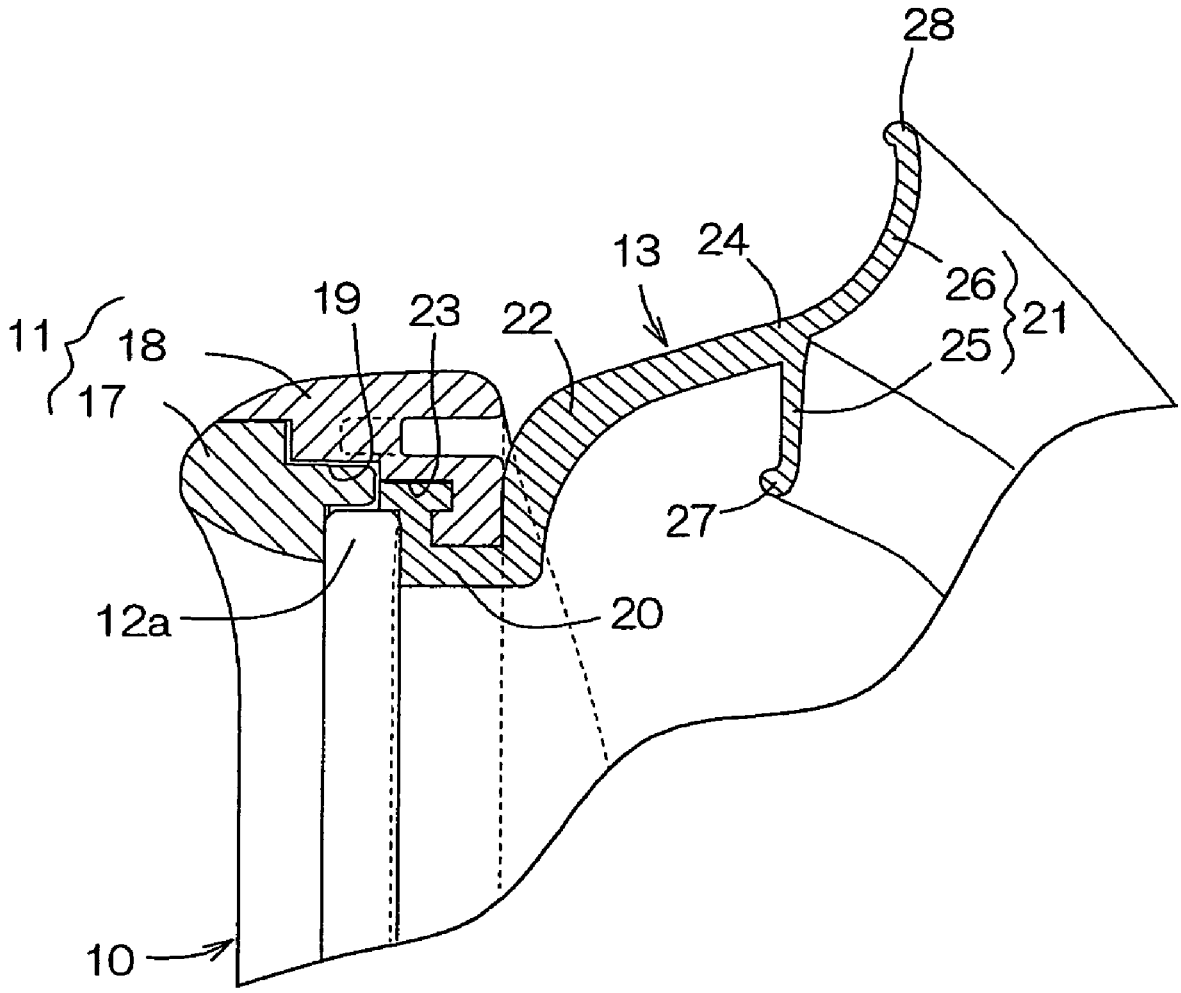
FIG. 4 is a view similar to FIG. 3, showing a second embodiment of the present invention.
Figure 5:
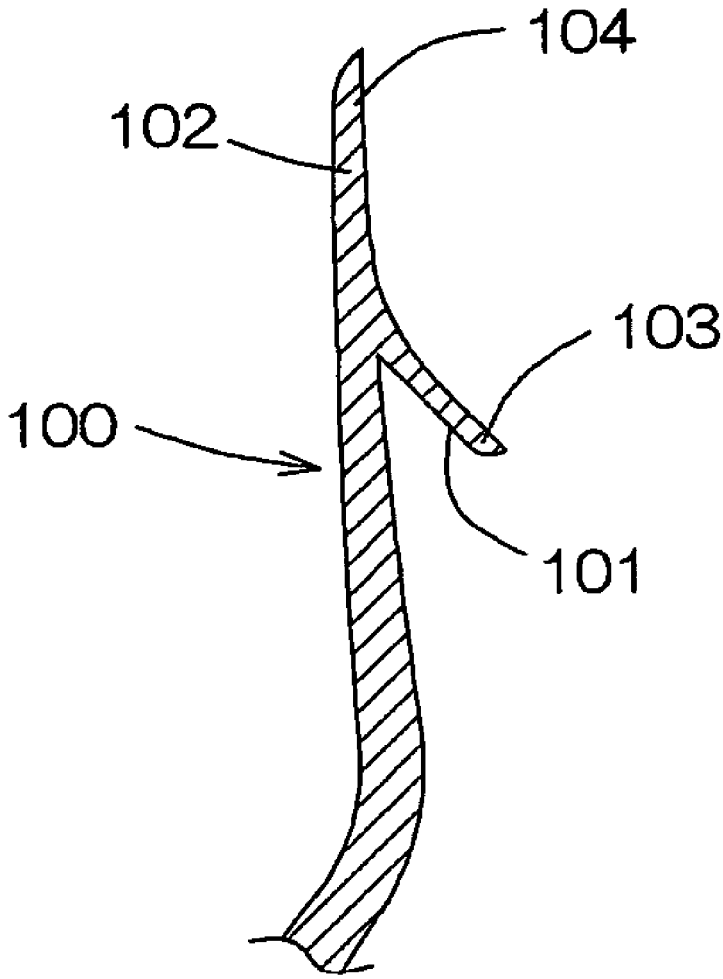
FIG.5 PRIOR ART
FIG. 5 is a partial sectional view showing a cross-sectional shape of a face-contactable section of a skirt in a conventional face mask for diving.

FIG. 4 illustrates a second embodiment of the face mask for diving according to the invention. This embodiment is similar to the embodiment shown in FIGS. 1 through 3 except a slight difference in configuration of the outward extending sub-section 26 of the face-contactable section 21. In view of this, the same reference numerals as those in FIGS. 1 through 3 are used here and the configuration other than that of the outward extending sub-section 26 will not be repetitively explained.

The outward extending sub-section 26 of the face-contactable section 21 according to this embodiment has its inner surface concavely curved. The outward extending sub-section 26 is deformed against the elasticity due to its initial curve, i.e., the cushion elasticity to a substantially planar state and an area over which this sub-section 26 is elastically pressed against the wearer's face is enlarged. Thus a stability with which the face mask is put on the wearer's face is improved and this embodiment is advantageous for improvement in the preventive effect to prevent water from flooding the interior of the face mask. If desired, the inward extending sub-section 25 also may be curved in the same manner as the outward extending sub-section 26.

The arrangement that the skirt 13 is formed to be most thick in the region of the intermediate section adjacent the proximal edge 20 provides another advantage that this thickest region serves as reinforcing means and thereby assures high shape retention of the face mask put on the wearer's face. The arrangement that the thickness of the skirt 13 is gradually reduced toward the face-contactable section 21 while thickness of the in- and outward extending sub-sections 25, 26 constituting together the face-contactable section 21 are also gradually reduced from the bifurcation point 24 toward the respective distal edges 27, 28 ensures that a soft, reliable and water-tight fit of the face mask to the wearer's face without undesired deformation.

The entire discloses of Japanese Patent Application No. 2005-18222 filed on Jan. 26, 2005 including specification, drawings and abstract are herein incorporated by reference in its entirety.

What is claimed is:

1. A face mask for diving comprising:

a lens frame including a lens retained thereby;

a substantially cylindrical skirt having a proximal edge fixed to said lens frame and a face-contactable section adapted to be elastically held in contact with the wearer's face;

wherein said face-contactable section has a distal edge roundly bulging so as to have a substantially circular cross-sectional shape, wherein said face-contactable section is bifurcated into an inward extending sub-section and an outward extending sub-section both having respective distal edges roundly bulging so as to have substantially circular cross-sectional shapes.

2. The face mask as defined by claim 1, wherein said skirt has a bifurcation point located approximately at midpoint between said proximal edge and said distal edge of said outward extending sub-section and wherein said skirt has a thickness gradually reduced from said bifurcation point toward said distal edges of said inward and outward extending sub-sections and increased again at said distal edges.

3. The face mask as defined by claim 1, wherein at least said outward extending sub-section of said inward and outward extending sub-sections has a concavely curved surface opposite a face contactable surface of the outward extending sub-section, the concavely curved surface present prior to any contact of the outwardly extending subsection with a face of a user.

4. A face mask for diving comprising:

a lens frame including a lens retained thereby;

a substantially cylindrical skirt having a proximal edge fixed to said lens frame and a face-contactable section adapted to be elastically held in contact with the wearer's face;

wherein said face-contactable section has a distal edge roundly bulging so as to have a substantially circular cross-sectional shape, wherein said skirt has a bifurcation point located approximately at midpoint between said proximal edge and said distal edge an outward extending sub-section, the skirt also having an inward extending sub-section, wherein said skirt has a thickness gradually reduced from said bifurcation point toward said distal edges of said inward and outward extending sub-sections and increased again at said distal edges.

5. The face mask as defined by claim 4, wherein at least said outward extending sub-section of said inward and outward extending sub-sections has its inner surface concavely curved.

6. A face mask for diving comprising:

a lens frame including a lens retained thereby;

a substantially cylindrical skirt having a proximal edge fixed to said lens frame and a face-contactable section adapted to be elastically held in contact with the wearer's face;

wherein said face-contactable section has a distal edge roundly bulging so as to have a substantially circular cross-sectional shape, wherein said face-contactable section is bifurcated into an inward extending sub-section and an outward extending sub-section, and wherein at least said outward extending sub-section of said inward and outward extending sub-sections has a concavely curved surface opposite a face contactable surface of the outward extending sub-section, the concavely curved surface present prior to any contact of the outwardly extending subsection with a face of a user.

* * * * *